United States Patent [19]

Zitz et al.

[11] Patent Number: 4,542,942

[45] Date of Patent: Sep. 24, 1985

[54] BIT HOLDER EQUIPPED WITH A SPRAYING DEVICE

[75] Inventors: Alfred Zitz; Herwig Wrulich; Otto Schetina; Wilfried Maier, all of Zeltweg, Austria

[73] Assignee: Voest-Alpine Aktiengesellschaft, Vienna, Austria

[21] Appl. No.: 504,302

[22] Filed: Jun. 14, 1983

[30] Foreign Application Priority Data

Jul. 6, 1982 [AT] Austria ..... 2615/82

[51] Int. Cl.[4] ..... E21B 10/60

[52] U.S. Cl. ..... 299/81; 175/393; 299/86

[58] Field of Search ..... 299/81, 86, 12; 175/243, 427, 393

[56] References Cited

U.S. PATENT DOCUMENTS

| | | | |
|---|---|---|---|
| 2,013,838 | 9/1935 | Pickin | 175/243 |
| 4,333,687 | 6/1982 | Barnstorf | 299/81 |

FOREIGN PATENT DOCUMENTS

| | | | |
|---|---|---|---|
| 1126766 | 6/1982 | Canada | 299/81 |
| 60827 | 9/1982 | European Pat. Off. | 299/81 |
| 685821 | 9/1979 | U.S.S.R. | 299/81 |
| 717326 | 2/1980 | U.S.S.R. | 299/81 |

*Primary Examiner*—Stephen J. Novosad
*Assistant Examiner*—M. Goodwin
*Attorney, Agent, or Firm*—Cushman, Darby & Cushman

[57] ABSTRACT

A bit holder equipped with a spraying device, comprising a receiving bore (2) in which the bit shaft (3) is supported, for limited axial shifting movement and optionally for being rotated, shifting movement of the bit shaft (3) in direction of the cutting pressure being limited by abutment (5) and the bit shaft being loaded by a return force in opposite direction to the cutting pressure and a valve (10, 11) for the supply of water to the bit or to the working or drift face during cutting operation being arranged within the bit holder (1) and being opened under the action of the cutting pressure by the axial shifting movement of the bit shaft (3). The valve housing (9) is inserted into the receiving bore (2). The rear end of the bit shaft (3) acts directly on the shaft (12) of the valve cone (10). Within the mantle of the receiving bore (2) and in front of the valve housing (9) there are provided passages (16) through which contaminations entering into the receiving bore (2) along the bit shaft (3) can be discharged in outward direction before they can arrive at the valve seat (11). The shaft (12) of the valve cone (10) is preferably guided within the valve housing (9), so that contaminations are rinsed in outward direction through the passages (16) by the leakage water flowing therethrough.

8 Claims, 3 Drawing Figures

BIT HOLDER EQUIPPED WITH A SPRAYING DEVICE

Figure 1:
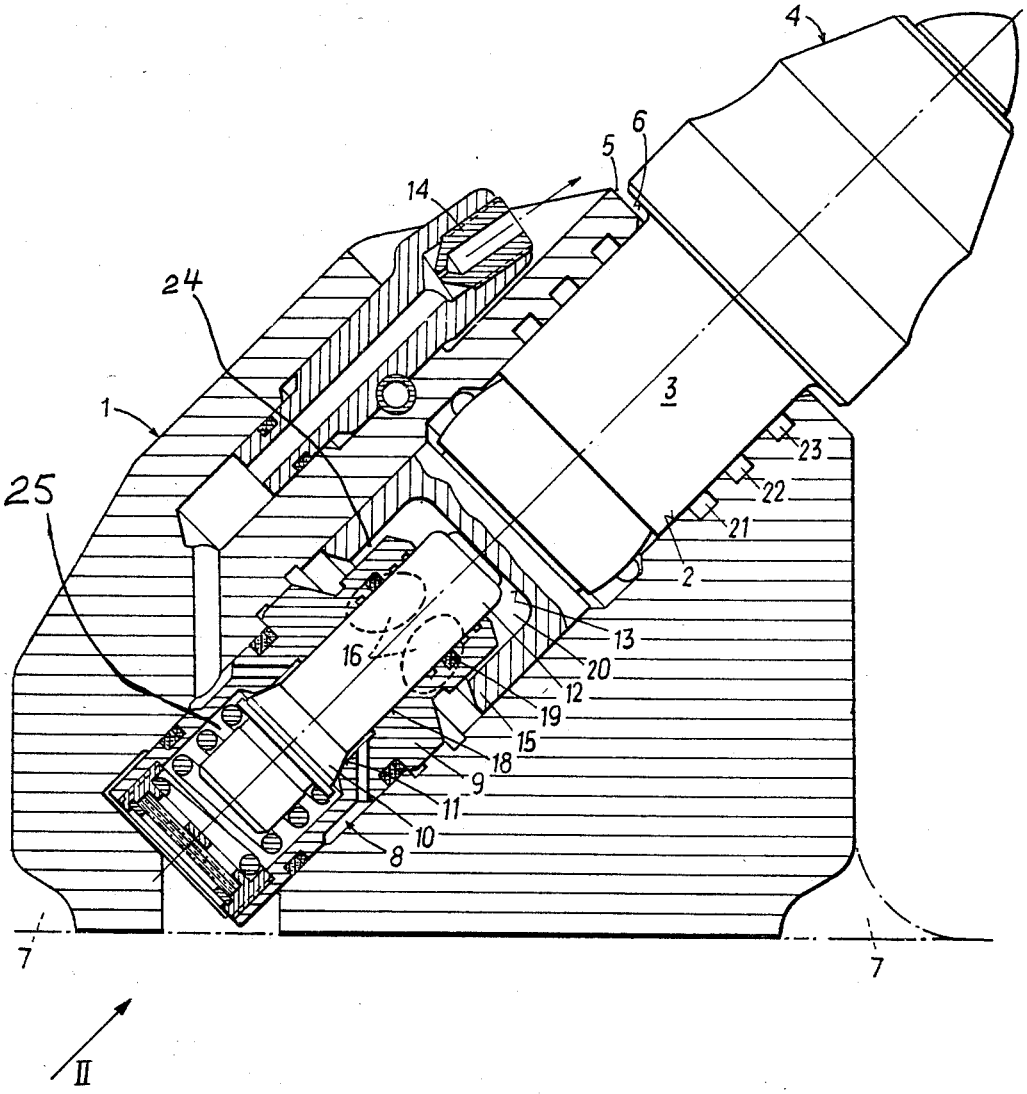

The invention refers to a bit holder equipped with a spraying device, in particular for cutting heads, comprising a receiving bore within which the shaft of the bit is supported, optionally with interposition of a bushing, for limited axial shifting movement and optionally for being rotated, shifting movement of the bit shaft in direction of the cutting pressure being limited by abutment and the bit shaft being loaded by a return force in opposite direction to the cutting pressure and a valve for the supply of water to the bit or to the drift face during cutting operation being arranged within the bit holder and being opened under the action of the cutting pressure by the axial shifting movement of the bit shaft. In the known bit holders of this type being equipped with a valve for the supply of the water to the spraying nozzle, the shifting movement of the bit shaft effected under the action of the cutting pressure is transmitted to the valve via a lever arrangement. Such a transmission mechanism results in a complicated construction. The receiving bore for the bit shaft within the bit holder is open at the rear side of the bit shaft for accommodating the transmission links transmitting the axial shifting movement of the bit shaft to the valve and this again results in weakening the bit holder.

The object of the invention is to simplify the transmission of the movement of the bit holder to the valve and to avoid simultaneously weakening of the bit holder. For solving this task the invention essentially consists in that the receiving bore is at least partially closed at its end located remote from the bit tip, in that the housing of the valve is arranged within the receiving bore at its deepest area and coaxially relative to this receiving bore, the end of the bit shaft located remote from the bit tip being acting on the actuating member of the valve, and in that the mantle of the receiving bore has between the seat of the valve and the mouth of the receiving bore and at an axial distance from the mouth of the receiving bore being greater than or equal to the axial depth over which the bit shaft protrudes into the receiving bore in its position engaging the abutment at least one perforation opening at the exterior side of the bit holder. In view of the receiving bore being at least partially closed at its end located remote from the bit tip, any weakening of the bit holder is avoided. In view of the housing of the valve being arranged within the receiving bore in coaxial relation to the bit shaft, the rear end of the bit shaft can directly act on the actuating member of the valve, which results in a simplification of the actuation of the valve. Such an arrangement allows a more simple construction of the bit holder because now only one bore is required which simultaneously serves as the receiving bore for the bit shaft and as the receiving bore for the valve housing. Therefore, the bit holder can also be given smaller dimensions. By arranging within the mantle of the receiving bore and between the seat of the valve and the mouth of the receiving bore, i.e. at an axial distance from the mouth being greater than or equal to the axial depth till which reaches the bit shaft, outwardly opening perforations it is avoided that contaminations or liquids entered between bit shaft and receiving bore arrive at the valve seat. This is of importance because by the axial shifting movement of the bit shaft a pumping action is created which favourizes transport of contaminations till the rear end of the bit shaft. If dirt would arrive at the valve seat, the valve would become untight at any rate. Those contaminations which are transported by this pumping action till the end of the bit shaft emerge through the perforation or the perforations and can thus not arrive at the area of the valve seat. According to the invention, a passage including an acute angle with the axis of the receiving bore, the vertex of said angle showing in direction to the mouth of the receiving bore, can join the perforation. Removal of contaminations is favourized by the oblique position of this passage or these several passages.

The valve is conveniently a cone valve and the shaft of the valve cone being acted upon by the bit shaft is, according to the invention, preferably untightly guided within the valve housing. On account thereof, water enters the receiving bore and this results in the advantage that the dirt is rinsed through the passages in outward direction. According to a preferred embodiment of the invention the shaft of the valve cone is, with this embodiment, only partially sealed relative to the valve housing by means of a slotted sealing ring. In this manner, any leakage losses and thus the amount of water entering the receiving bore can exactly be defined by the size of the slot. In this case and according to the invention the arrangement is conveniently such that the end portion, located remote from the bit tip, of the bit shaft embraces the shaft of the valve cone in a cup-like manner. In this manner there results an annular gap between the cup-shaped end portion of the bit shaft and the shaft of the valve cone or, respectively, the valve housing portion within which is guided the valve shaft. Leakage water is emerging at the end of the valve guide and must thus rinse this annular gap. In this manner it is prevented that contaminations may pass through the annular gap till the valve shaft in opposite direction to the rinsing stream.

According to the invention, the allowed stroke of the valve cone is conveniently greater than the axial path of the bit shaft till the abutment. This provides, so to say, a reserve stroke, so that also in case of any wear of the contacting surface of the valve shaft contacting the bit shaft the valve can reliably be opened.

If, for increasing the wear resistance of the receiving bore guiding the bit shaft, a bushing is press-seated within the receiving bore, the perforations can, according to the invention, be arranged in at least one cross-sectional plane behind the inner end of the bushing. This is a convenient embodiment because in this case the bushing need not be perforated by boring operation.

In an advantageous manner and according to the invention, annular grooves can be provided on the internal side of the receiving bore or the bushing, respectively, between the mouth of the receiving bore and the perforations. In this case, a sealing ring can be placed within at least one of the annular grooves while the remaining annular grooves act as dirt catching grooves. This reduces the amount of dirt arriving at the deepest position of the receiving bore and thus also the amount of dirt to be removed through the perforations.

In the drawing, the invention is schematically illustrated with reference to an embodiment.

In the drawing

Figure 2:
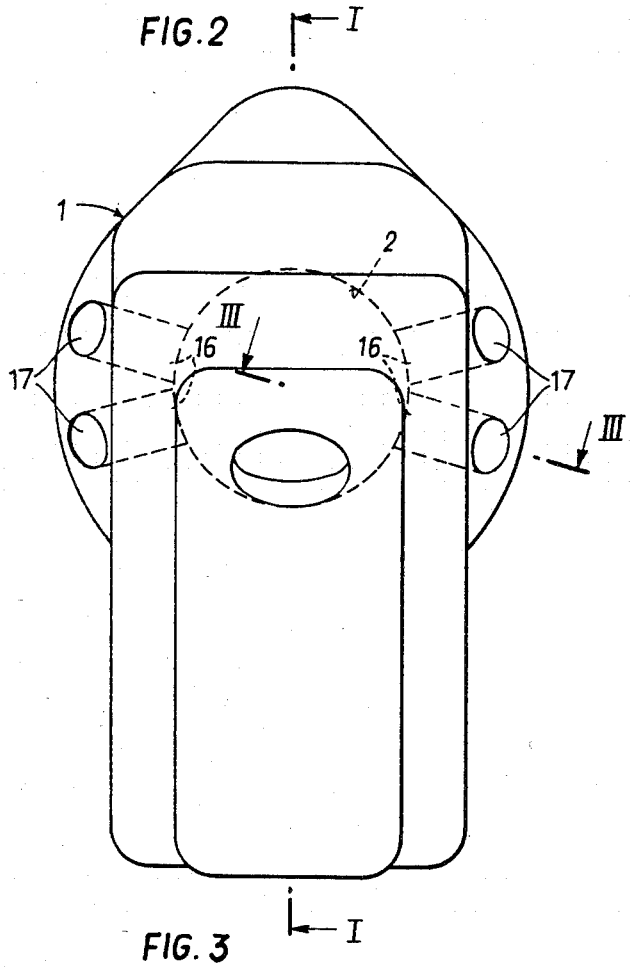
Figure 3:
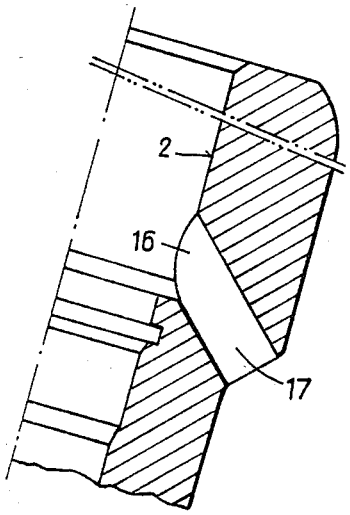

FIG. 1 shows a section through the bit holder along line I—I of FIG. 2 and in the axis of the receiving bore, FIG. 2 shows a view of the bit holder in direction of the arrow II in FIG. 1 and FIG. 3 shows a section along line III—III of FIG. 2.

Within the bit holder 1, a receiving bore 2 for the shaft 3 of the bit 4 is provided. The shaft 3 of the bit 4 is supported within the receiving bore for rotation and for axial shifting movement. The bit holder 1 has an abutment 5 with which is cooperating an abutment shoulder 6 of the bit 4, so that the path of movement of the shaft 3 is limited in direction of the cutting pressure. The bit holder 1 is welded to a cutting head at 7.

The receiving bore 2 is not a through-bore but is designed as a blind bore. At the rearward area 8 of the receiving bore 2 there is inserted a valve housing 9 of a valve 10, 11. The valve cone is designated 10 and the valve seat is designated 11. The forward end of the shaft 12 of the valve cone 10 contacts the bit shaft at 13. If the bit shaft is, during cutting operation, shifted in direction of the cutting pressure, the bit shaft lifts the valve cone 10 off its seat 11 and thus gives free the supply of water via an annular groove 8 to a nozzle 14 housed within the bit holder 1, said nozzle directing a water jet against the bit 4 and the drift face, respectively. Supply of water to the space 25 located in front of the valve seat 11 is effected by means of a bore, not shown, in the bit holder 1.

Behind the rear end portion 15 of the bit shaft 3 there are provided within the wall of the receiving bore 2 perforations 16 through which dirt having entered the receiving bore 2 is removed in outward direction. As is shown in FIGS. 2 and 3, channels 17 opening in outward direction laterally of the bit holder 1 join these perforations. Each passage 17 joins its respective perforation 16 at an acute angle, with the vertex of the angle facing in the direction of the mouth of the receiving bore 2.

The valve shaft 12 is guided within bore 18 of the valve housing and sealed by means of a sealing ring 19. This sealing ring is of slotted design, so that a certain amount of leakage water can enter the space 20 behind the bit shaft 3. By means of this leakage water, the amount of which is defined by the slot within the sealing ring 19, dirt accummulating within the space behind the bit shaft 3 is rinsed in outward direction through the perforation 16 and the channels 17. This is favourized in view of the fact that the rearward end portion of the bit shaft 3 embraces the shaft 12 of the valve cone in a cup-like manner. In this manner an annular gap 24 is formed which is rinsed by the leakage water.

A bushing, not shown, can be press-seated within the receiving bore 2. Annular grooves 21, 22 and 23 are provided at the internal side of the receiving bore 2. A sealing can be placed within the annular groove 22. The annular grooves 21 and 23 can act as dirt catching grooves. If a bushing is press-seated within the receiving bore 2, the grooves 21, 22 and 23 can be provided at the internal side of this bushing.

What is claimed is:

1. Bit holder equipped with a spraying device which includes a nozzle, in particular for cutting heads, comprising a receiving bore having an open outer end, said receiving bore being separate from the nozzle and receiving and supporting the shaft of the bit for limited axial shifting movement and optionally for being rotated, shifting movement of the bit shaft in direction of the cutting pressure being limited by an abutment and the bit shaft being loaded by a return force in opposite direction to the cutting pressure and a valve for the supply of water to the bit or to the drift face during cutting operation being arranged within the bit holder and being opened under the action of the cutting pressure by the axial shifting movement of the bit shaft, characterized in that the receiving bore is at least partially closed at its end located remote from the bit tip, in that the housing of the valve is arranged within the receiving bore at its deepest area and coaxially relative to this receiving bore, the end of the bit shaft located remote from the bit tip being acting on the valve shaft of the valve, and in that the wall of the receiving bore has between the seat of the valve and the mouth of the receiving bore and at an axial distance from the mouth of the receiving bore which is greater than or equal to the axial depth over which the bit shaft protrudes into the receiving bore in its position engaging the abutment at least one perforation opening at the exterior side of the bit holder.

2. Bit holder according to claim 1, characterized in that a passage (17) including an acute angle with the axis of the receiving bore (2), the vertex of said angle showing in direction to the mouth of the receiving bore, joins the perforation (16).

3. Bit holder according to claim 1, characterized in that the shaft (12) of the valve cone (10) being acted upon by the bit shaft (3) is untightly guided within the valve housing (9).

4. Bit holder according to claim 3, characterized in that the shaft (12) of the valve cone (10) is only partially sealed, relative to the valve housing (9) by means of a slotted sealing ring.

5. Bit holder according to claim 1, characterized in that the bit shaft has an end portion (15), located remote from the bit tip, which embraces the shaft (12) of the valve cone (10) in a cup-like manner.

6. Bit holder according to claim 1, characterized in that the possible stroke of the valve cone (10) is greater than the axial path of the bit shaft into engagement with the abutment (5).

7. Bit holder according to claim 1, characterized in that annular grooves (21, 22, 23) are provided on the internal side of the receiving bore (2) between the mouth of the receiving bore (2) and the perforation (16).

8. Bit holder according to claim 7, characterized in that a sealing ring is placed within at least one of the annular grooves (21, 22, 23) and the remaining annular grooves act as dirt catching grooves.

* * * * *